US005749809A

United States Patent [19]

Lin

[11] Patent Number: 5,749,809

[45] Date of Patent: May 12, 1998

[54] STEPPING AND SWINGING EXERCISER

[76] Inventor: Ting Fung Lin, 12F-1, No. 83, Suei Yuan Road, Taipei, Taiwan

[21] Appl. No.: 879,311

[22] Filed: Jun. 20, 1997

[51] Int. Cl.[6] ..... A63B 22/00

[52] U.S. Cl. ..... 482/52

[58] Field of Search ..... 482/51, 52, 53, 482/70, 79, 80, 111, 112, 62; 434/247, 255; 601/33, 35

[56] References Cited

U.S. PATENT DOCUMENTS 4,563,001 1/1986 Terauds ..... 482/53
4,940,233 7/1990 Bull et al. ..... 482/52
5,039,088 8/1991 Shifferaw ..... 482/57
5,595,555 1/1997 Chen ..... 482/51

*Primary Examiner*—Stephen R. Crow

[57] ABSTRACT

An exerciser includes a base having a front axle for supporting a handle. A pair of foot supports are pivotally coupled to a front post and coupled to the axle for applying a rotational operation to the axle by a rotational movement of the foot supports. A pulley is secured to the rod and a cable is engaged over the pulley and secured to the foot supports for allowing the foot supports to rotate the rod. Two bevel gears are secured to the axle and the rod and engaged with each other for allowing the rod to rotate the axle and the handle.

4 Claims, 2 Drawing Sheets

STEPPING AND SWINGING EXERCISER

BACKGROUND OF THE INVENTION

1. Field of the Invention

The present invention relates to an exerciser and more particularly to an exerciser for conducting stepping and swinging exercises.

2. Description of the Prior Art

Some of the typical exercisers may be provided for conducting stepping exercises, and some other exercises may be used for conducting rotating exercises. However, none of the conventional exercisers may be used for conducting both stepping and swinging exercises.

The present invention has arisen to mitigate and/or obviate the afore-described disadvantages of the conventional exercisers.

SUMMARY OF THE INVENTION

The primary objective of the present invention is to provide an exerciser which may be used for conducting both stepping and swinging exercises.

In accordance with one aspect of the invention, there is provided an exerciser comprising a base including a front portion and including a rear portion having a post extended upward from the base, the post including an upper portion having a pivot shaft, a pair of foot supports pivotally coupled to the post at the pivot shaft, an axle rotatably secured on the front portion of the base and adapted to be rotated about a vertical axis, a handle secured to the axle and rotated in concert with the axle about the vertical axis, and means for coupling the foot supports to the axle and for applying a rotational operation to the axle by a rotational movement of the foot supports about the pivot shaft.

The coupling means includes a rod rotatably supported on the base, the rod includes a front end and a rear end, the coupling means includes a first driving means for applying a rotational operation to the rod by the rotational movement of the foot supports about the pivot shaft and includes a second driving means for applying a rotational operation to the axle by a rotational movement of the rod.

The first driving means includes a pulley secured on the rear end of the rod and includes a cable engaged over the pulley and having two ends secured to the foot supports for allowing the foot supports to apply the rotational operation to the rod by the rotational movement of the foot supports about the pivot shaft.

The second driving means includes a first bevel gear secured on the axle and includes a second bevel gear secured on the front end of the rod for engaging with the first bevel gear and for allowing the rod to rotate the axle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
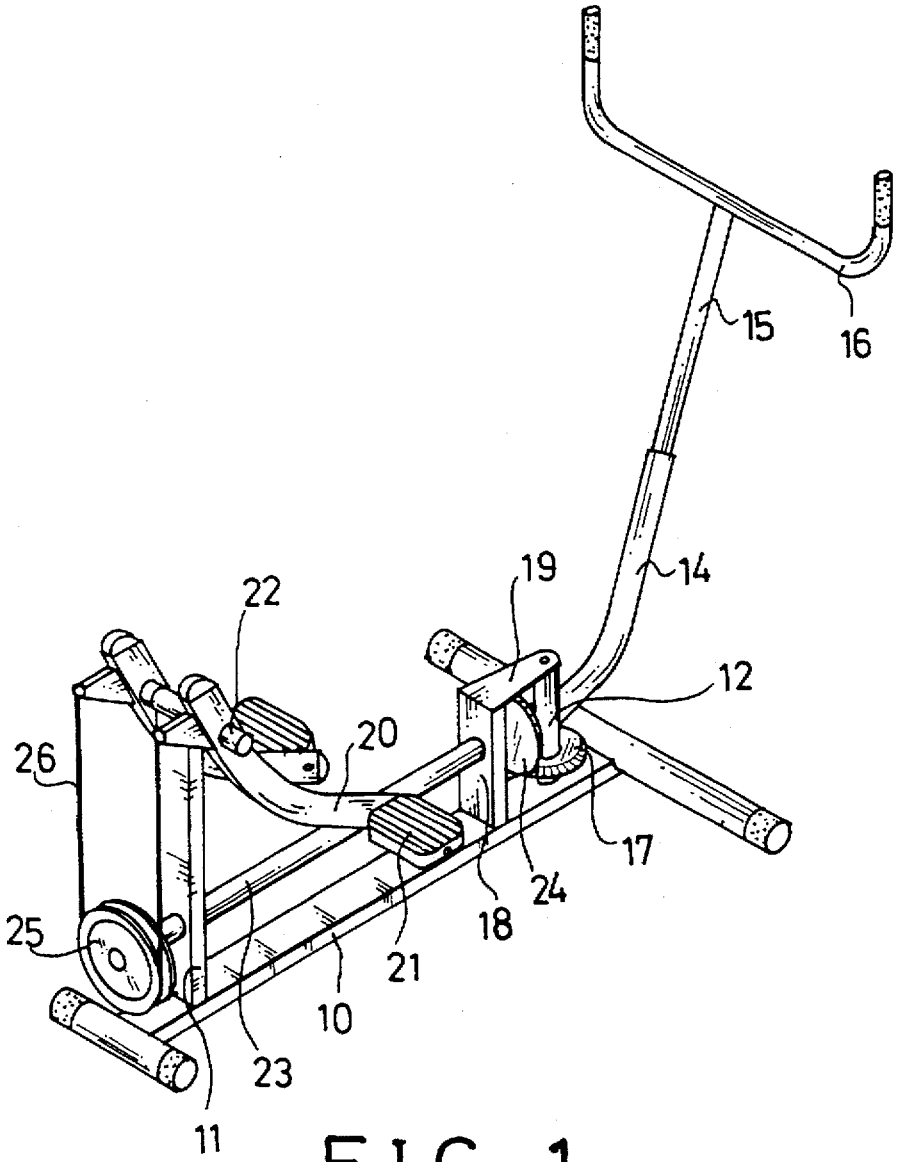
FIG. 1 is a perspective view of an exerciser in accordance with the present invention.
Figure 2:
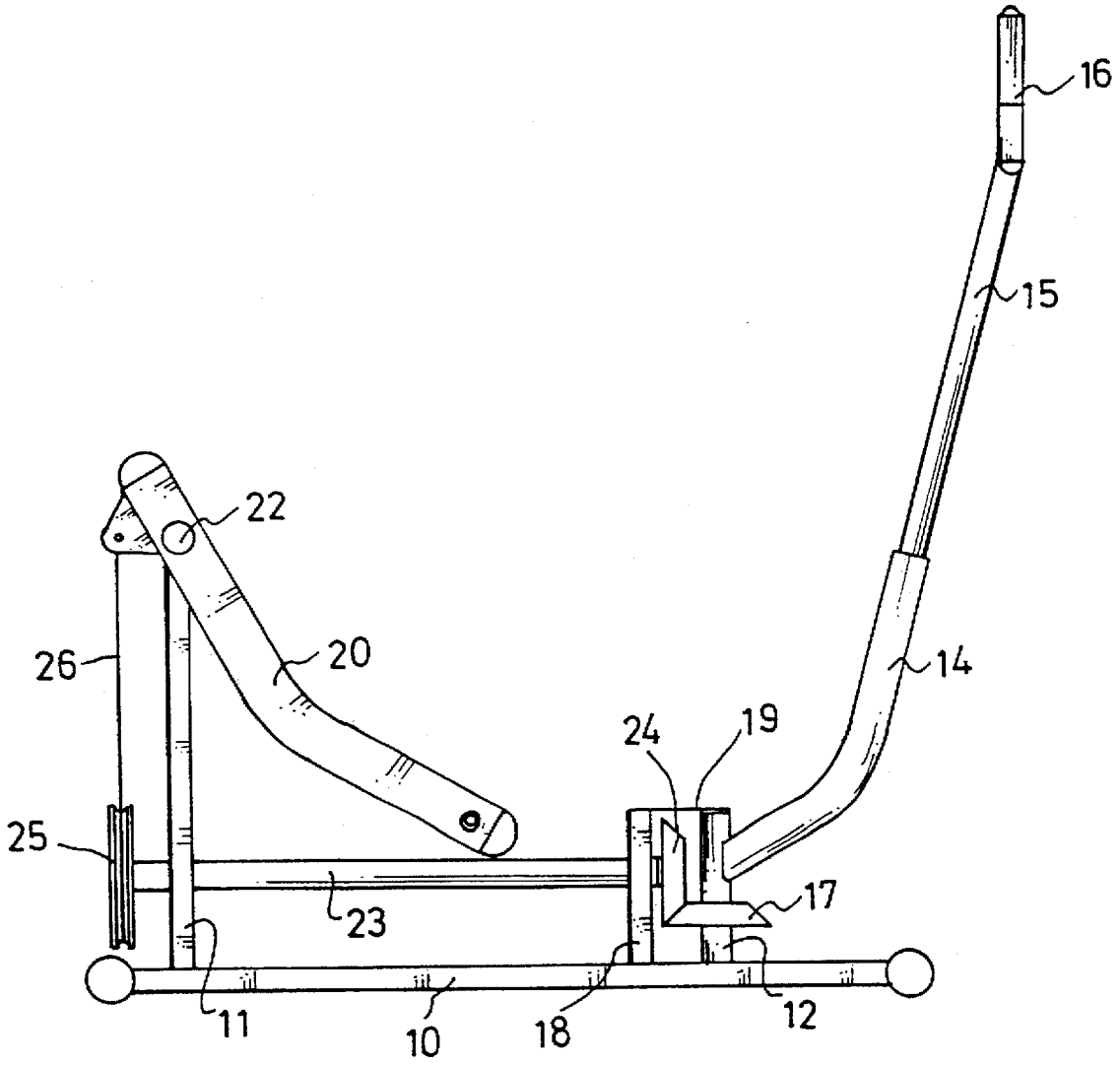
FIG. 2 is a side view of the exerciser.

Referring to the drawings, an exerciser in accordance with the present invention comprises a base 10 including a post

11 extended upward from the rear portion and including an axle 12 rotatably secured in the front portion and rotatable about a vertical axis. A bar 18 is extended upward from the front portion of the base 10 and disposed between the post 11 and the axle 12. A beam 19 is extended forward from the top of the bar 18 for rotatably securing the axle 12 in place. A tube 14 has a bottom end secured to the axle 12 and rotated in concert with the axle 12. An extension 15 has a lower portion slidably engaged in the tube 14 and has a handle 16 provided on top. The extension 15 may be adjusted relative to the tube 14 for adjusting the height of the handle 16. The handle 16 may thus be rotated about the vertical axis of the axle 12 and rotated in concert with the axle 12. A bevel gear 17 is secured to the axle 12.

A pair of foot supports 20 each has a foot pedal 21 secured to the front portion and each has a rear portion pivotally secured to the top of the post 11 at a pivot shaft 22 for allowing the foot supports 20 to be rotated about the pivot shaft 22. A rod 23 is rotatably supported in the post 11 and the bar 18. A bevel gear 24 is secured to the front end of the rod 23 and is engaged with the bevel gear 17 of the axle 12 for allowing the axle 12 to be rotated by the rod 23. A pulley 25 is secured to the rear end of the rod 23. A cable 26 is engaged over the pulley 25 and has two ends secured to the foot supports 20 for allowing the pulley 25 to be rotated by the cable 26 when the foot supports 20 are rotated about the pivot shaft 22.

In operation, the rod 23 may be rotated by the cable 26 and the pulley 25 and by the rotational movement of the foot supports 20 about the pivot shaft 22. The axle 12 may be rotated or swung in a reciprocating action by the rod 23 via the bevel gears 17, 24 such that the handle 16 may be rotated about the pivot axle 12 when the foot supports 20 are stepped by the user and are rotated about the pivot shaft 22. The exerciser may thus be used for conducting both stepping and swinging exercises.

Alternatively, the pulley 25 and the chain 26 may be replaced by chain and sprocket or replaced by gears and racks or other similar driving members for applying a rotational operation to the rod by the rotational movement of the foot supports 20 about the pivot shaft 22.

Accordingly, the exerciser in accordance with the present invention may be used for conducting both stepping and swinging exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion and including a rear portion having a post extended upward from said base, said post including an upper portion having a pivot shaft, a pair of foot supports pivotally coupled to said post at said pivot shaft, an axle rotatably secured on said front portion of said base and adapted to be rotated about a vertical axis, a handle secured to said axle and rotated in concert with said axle about said vertical axis, and means for coupling said foot supports to said axle and for applying a rotational operation to said axle by a rotational movement of said foot supports about said pivot shaft.

2. An exerciser according to claim 1, wherein said coupling means includes a rod rotatably supported on said base, said rod includes a front end and a rear end, said coupling means includes a first driving means for applying a rotational operation to said rod by said rotational movement of said foot supports about said pivot shaft and includes a second driving means for applying a rotational operation to said axle by a rotational movement of said rod.

3. An exerciser according to claim 2, wherein said first driving means includes a pulley secured on said rear end of said rod and includes a cable engaged over said pulley and having two ends secured to said foot supports for allowing said foot supports to apply said rotational operation to said rod by said rotational movement of said foot supports about said pivot shaft.

4. An exerciser according to claim 2, wherein said second driving means includes a first bevel gear secured on said axle and includes a second bevel gear secured on said front end of said rod for engaging with said first bevel gear and for allowing said rod to rotate said axle.

* * * * *